US006006904A

United States Patent [19]

Jacobsen

[11] Patent Number: 6,006,904

[45] Date of Patent: Dec. 28, 1999

[54] GOLF CLUB LOCKING MECHANISM

[76] Inventor: Norman T. Jacobsen, 7765 SE. Spicewood Cir., Hobe Sound, Fla. 33455

[21] Appl. No.: 09/046,273

[22] Filed: Mar. 23, 1998

Related U.S. Application Data

[60] Provisional application No. 60/041,479, Mar. 25, 1997.

[51] Int. Cl.[6] ..... A63B 55/00; A63B 57/00

[52] U.S. Cl. ..... 206/315.6; 206/315.2; 206/315.3; 70/58

[58] Field of Search ..... 206/315.2, 315.3, 206/315.6; 70/58

[56] References Cited

U.S. PATENT DOCUMENTS

| | | | |
|---|---|---|---|
| 1,717,959 | 6/1929 | Cauffman | 206/315.6 |
| 1,731,588 | 10/1929 | Patterson | 206/315.6 |
| 1,770,060 | 7/1930 | Barlow | 206/315.6 |
| 4,538,728 | 9/1985 | Lewis | 206/315.3 |
| 4,860,889 | 8/1989 | Lemieux et al. | 206/315.6 |
| 5,004,100 | 4/1991 | Smith | 206/315.2 |
| 5,524,753 | 6/1996 | Murphy | 206/315.6 |
| 5,636,735 | 6/1997 | Stusek | 206/315.6 |

FOREIGN PATENT DOCUMENTS

| | | | |
|---|---|---|---|
| 2181410 | 1/1997 | Canada | 206/315.6 |
| 2646785 | 11/1990 | France | 206/315.6 |
| 9604045 | 2/1996 | WIPO | 206/315.6 |

*Primary Examiner*—Sue A. Weaver
*Attorney, Agent, or Firm*—McHale & Slavin PA

[57] ABSTRACT

Disclosed is a golf club locking mechanism consisting of a one piece annular member having a plate with a plurality of equally sized holes and a rotatable disk placed beneath the fixed disk annular member having aperture holes both circular and oblong shape so as to cause closure of the apertures upon rotation of the disk and locking thereof so as to prohibit removal of golf clubs placed therethrough. The device also includes a cable locking mechanism for securing the golf bag to a fixed object.

13 Claims, 2 Drawing Sheets

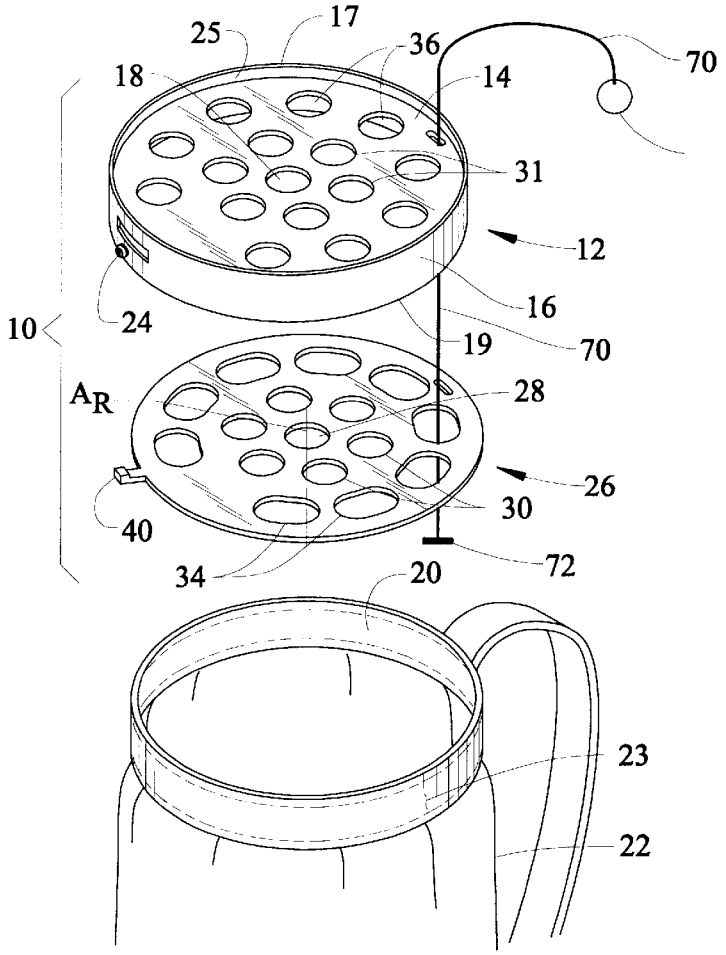
FIG. 1
FIG. 2
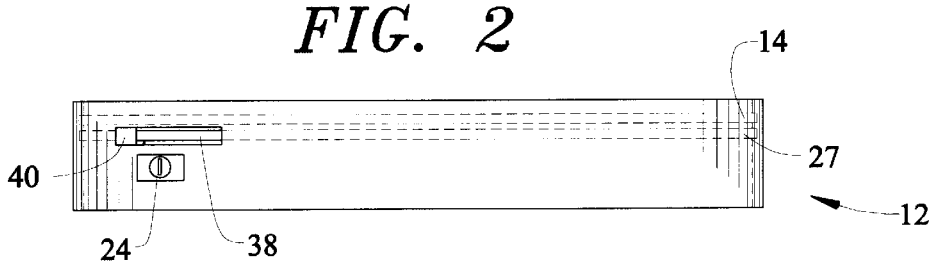
FIG. 3
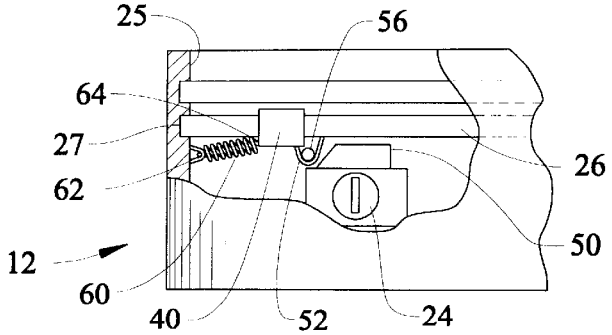

GOLF CLUB LOCKING MECHANISM

This disclosure is based upon Provisional Patent Ser. No. 60/041,479 filed Mar. 25, 1997, the contents of which are incorporated herein by reference.

FIELD OF THE INVENTION

This invention relates to the field of golf and more particularly to a locking device for securing golf clubs.

BACKGROUND OF THE INVENTION

The game of golf is an immensely popular activity that is played throughout the world. The premise of the game requires ball control for purpose of completing a course in as few strokes as possible. Skill is a major consideration in obtaining lower scores but the technology has also advanced to allow even an amateur to obtain a respectable score. Unfortunately, the popularity of the game and the high cost of golf equipment results in a problem with theft. While theft of golf equipment is not new, the use of high technology materials such as titanium and graphite has resulted in golf manufacturing of extremely expensive equipment.

Modern golf clubs consist of a matched set of irons and woods. The irons range in numbers from one through nine while woods generally range in numbers from one through four. Woods can, however, continue in number five through nine. Typically there are two golf clubs which command special attention to the golfer and to the golf club manufacturers. These are the driver and the putter. Because technology has focused in on these two clubs in particular, the desirability and the price of a driver and a putter has increased even beyond the price of modern and expensive golf clubs. A single driver can cost hundreds of dollars. A single putter can also cost hundreds of dollars. As a result, these two clubs in particular are subject to being stolen.

The golf clubs can be stolen from automobiles, public and private golf courses, during traveling or any other situation where the clubs or golf bag are left unattended for a brief period of time. Typically, the clubs are stolen from golf bags which contain all of the clubs of a golfer. For example, while a golf bag is on a golf cart, or at a golf rack along with dozens of other bags, or the golf club bag is being handled by a valet who takes the clubs to and from the golfer's car, or any other time where the clubs are left unattended for a brief period of time, a person can easily take the putter and the driver, multiple clubs, or the entire bag without being noticed. In such a situation, the inconvenience to the golfer is significant.

For these reasons, numerous golf locking devices have been disclosed with various forms of success. For instance, U.S. Pat. No. 1,770,060 discloses an anti-theft golf club receptacle that allows for capturing of the shafts of a golf club within an encasement which is lockable. The theft device pivots so as to cause golf club shaft openings to change in diametric size.

U.S. Pat. No. 1,717,959 discloses a golf club locking mechanism having at least two plate members with a centrally located pivot that allows a bottom plate member to move thereby changing the diametric size of openings to capture each golf club shaft therein.

U.S. Pat. No. 5,524,753 discloses yet another device for securing golf clubs. Clubs placed within slots are captured in the slot by movement of an underlying piece thereby decreasing the dimensional size of the slot opening.

U.S. Pat. No. 4,538,728 discloses a two piece pivoting shelf which operates as a lid for a golf club bag for securing the shafts of a group of golf clubs therein.

U.S. Pat. No. 5,636,735 discloses yet another golf bag security device. This device consists of multiple plate members having a centrally disposed pivot that allows the diameter of the hole openings to change upon rotation of the lower plate members.

However, what is lacking in the art is a golf club locking device that is simplistic in its component construction making it affordable for all consumers.

SUMMARY OF THE INVENTION

A golf club locking device formed from a one piece annular member secured to the top portion of a golf club bag by weldment, rivets, or formed integral thereto. The annular member includes a fixed plate member permanently secured to an inner side surface of the annular member. The plate member having a centrally disposed open aperture with a first upper set of circular apertures positioned around the open aperture and a second upper set of circular apertures positioned around the first set of apertures. The apertures are sized to accommodate the handles of the golf club;

A rotatable disk member is rotatably positioned beneath the fixed disk and is held in a groove placed along the inner side surface. The rotatable disk member includes a centrally disposed open aperture with a first lower set of circular apertures positioned around the open aperture and a second lower set of oblong shaped apertures positioned around the first lower set of apertures. As with the fixed disk, these apertures are sized to accommodate the handles of golf clubs when the apertures are placed in vertical alignment in relation to the fixed disk.

A spring biases the rotatable disk member in such a manner so as to maintain the lower apertures in vertical alignment with the upper apertures when in an unlocked position. A finger actuator permits rotation of the disk member, the actuator being accessible through the sidewall of the annular member.

A locking mechanism is used to secure the rotatable disk member in a position which operates to lock the golf club shafts in the golf bag. Thus, when the handles of golf clubs are inserted through the upper set of apertures and the lower apertures, rotation of the rotatable disk member causes a reduction in the size of the openings to prohibit golf club removal. Once the openings are reduced, the rotatable disk is locked in position to prevent further rotation. A self locking provision of the locking mechanism allows rotation from an unlocked position to a locked position by presetting of the lock.

The golf club locking device also includes a flexible steel cable having a proximal end secured to the golf bag and a distal end sized for insertion into one of the apertures. When the annular member is locked, the locking of the cable also occurs.

Thus, an objective of the instant invention is to disclose an inexpensive golf club locking device that is securable to a conventional golf club bag for purposes of locking golf clubs therein.

Another objective of the instant invention is to disclose a golf club locking device having a simplistic design, namely a single rotatable disk placed beneath a fixed plate. The rotatable disk having elongated slots to provide aperture locking on the fixed plate on a uniform basis.

Still another objective of the instant invention is to disclose a golf club locking device that provides for keyless locking.

Yet still another objective of the instant invention is to disclose a golf club locking device that includes a flexible steel cable for use in locking the golf bag to a fixed object.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 1 illustrates an exploded view positioned above a golf club bag;

FIG. 2 is a side view of the locking device;

FIG. 3 is a cross sectional side view of the device having a partial cut-a-way;

DETAILED DESCRIPTION OF THE PREFERRED EMBODIMENT

Figure 4:
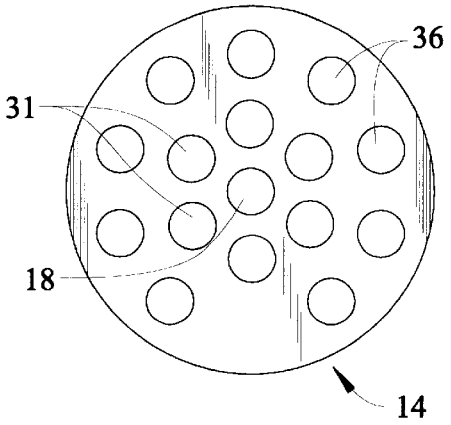
FIG. 4 is a top view of the fixed disk.

The invention will be described in terms of a specific embodiment, however, it will be readily apparent to those skilled in this art that various modifications, rearrangements, and substitutions can be made from departing from the spirit of this invention. The scope of this invention is defined by the claims appended hereto.

This Application is based upon Provisional patent Ser. No. 60/041,479 filed Mar. 25, 1997, the contents of which are incorporated herein by reference as if fully restated.

Now referring to FIGS. 1–3, set forth is the golf club locking device 10 consisting of a one piece annular member 12 which consists of a plate 14 having a plurality of equally sized circular apertures. The annular member 12 is defined by a vertical sidewall 16 having a minimal thickness with a top edge 17 and a bottom edge 19, said vertical sidewall 16 including a peripheral groove 27 disposed along an inner side surface 25 thereof. The apertures are sized to accommodate the shaft and the associated grip of a golf club as described in detail later in this specification. The amount of apertures may be sixteen or more to accommodate a standard set of clubs. A central aperture 18 does not lock and can be used for placing an umbrella, golf ball retriever, or the like device that need not be locked. The annular member 12 may be constructed of any type of rigid material including steel, fiber-glass, or plastic and is sized to be secured to the inner-rim 20 of a conventional golf bag 22. The device 10 can be secured to the rim 20 by any number of means including partial insertion of the vertical sidewall 16 of the annular member 12 to engage a portion of the inner-rim 20 where the annular member can be riveted, glued or otherwise secured to the rim. Similarly, the device 10 may be enlarged so as to partially engage an outer portion of the rim 23 again with attachment being made permanent. In this manner the device 10 may be sized to a particular golf bag or include the use of various spacers, not shown, so as to allow the annular member to accommodate various sized golf bag openings.

The one piece annular member 12 further houses a key lock 24 which is operatively associated with the rotatable disk 26 so as to lock the rotatable disk 26 in position for securement of the clubs to the golf bag. In operation, the rotatable disk 26 fits within the groove 27 of the one piece annular member 12 wherein rotation of the disk 26 allows the apertures to be unobstructed or by rotation of the disk the circular openings 31, 36 are partially closed. The axis of rotation $A_R$ of the rotatable disk 26 passes through the center of the rotatable disk. The rotatable disk has a centrally disposed circular opening 28 which is operatively associated with the central opening 18 of the plate 14 for placement of an item that need not be secured. For instance, a golf ball retriever, umbrella, or a cable for use in locking may be placed through the circular opening. Despite the rotation of the rotatable disk 26, the opening 18 and 28 remains unobstructed. A second set of circular openings 30 are place around a close diameter of the central opening 28 and operatively associated with a second set of openings 31 of the plate 14. During rotation of the rotatable disk 26, the circular openings 30 partially close the second set of circular openings 31 of the plate 14. An oblong set of openings 34 fit beneath a third set of circular openings 36 of plate 14. The oblong openings permit the circular openings 36 to remain open until rotation causes the openings to be partially closed as the oblong shaped openings 34 closes the openings from below.

FIG. 2 illustrates the one piece annular member 12 having the plate 14 positioned above the rotatable disk 26. A side opening 38 is placed in the side surface of the annular member 12 for engaging finger tab 40 that allows for manual movement of the rotatable disk 26. Key lock 24 prevents movement of the rotatable disk 26 when the mechanism is placed in a locked position. The annular member 12 includes a peripheral slot 27 located along the inner side surface 25 in slidable rotation of the rotatable disk 26. The disk 26 is placed within the groove 27 by pressed fit or during the manufacturing of the annular member 12. The plate 14 is secured to the inner-side surface 25 of the circular member by weldment or the plate can be made integral with the member.

Referring now to FIG. 3, set forth is a cutaway view of FIG. 2 showing the circular member 12 having the rotatable disk 26 and finger tab 40 so as to allow rotation of the disk in relation to the annular member 12. The lock 24 has a locking tab 50 which is placed in a raised position as shown for purposes of locking or rotated downward into the body allowing the rotating disk to be released. A spring biased engagement mechanism 52 is operatively associated with the lock 24 for positioning of the rotatable disk 26 in a fixed position. The locking mechanism 52 consists of a bracket and spring biased pinion 56 that is biased in an outward position as shown toward the rotatable disk when the disk is rotated across locking tab 50. In this manner the lock 24 may be engaged with the locking tab 50 raised wherein the golf club bag can be used in its ordinary manner. Thus, the rotatable disk 26 and the plate 14 are in alignment with the circular openings unobstructed. When the golfer wants to lock the golf clubs he can simply move the finger tab 40 to cause the rotatable disk 26 to move across the lock 24 wherein pinion 56 is raised over locking tab 50 into a locked position. The front of the locking tab 50 is angular allowing for the raising of the pinion with a flat rear edge to prevent the opposite rotation. Spring 60 has a first end 62 secured to the annular member and second end 64 secured to the rotatable disk in an open position. When the rotatable disk 26 is in a locked position the lock 24 may be rotated by a key, not shown, wherein locking tab 50 is lowered allowing the rotatable disk 26 to automatically move back to the open position.

Now referring to FIG. 4, shown is the one piece plate 14 having the centrally disposed aperture 18 surrounded by a first row of apertures 31 and a second row of apertures 36. The one piece plate 14 may be made of any rigid material with each aperture sized to accommodate the handle of a golf club with minimal interference. The apertures are further sized to accommodate proper spacing of the clubs and may be lined with felt or the like soft material, not shown, so as to prohibit marring of graphite shafts. The number of apertures is dependant upon the amount of clubs carried by an individual for most practical purposes consists of approximately sixteen apertures which accommodates the average number of golf clubs employed by a golfer.

Figure 5:
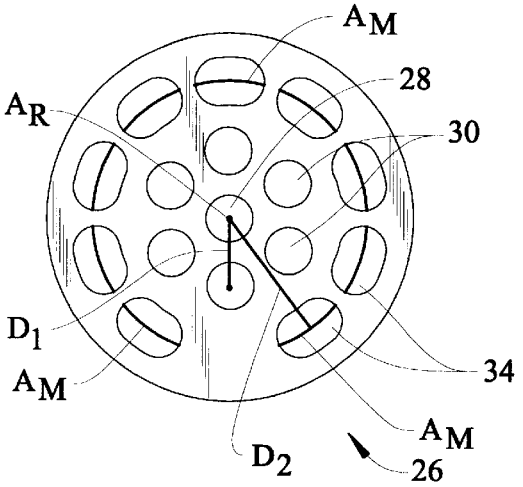
FIG. 5 is a top view of the rotatable disk.

FIG. 5 sets forth the rotatable disk 26 having a centrally disposed aperture 28 having the same size as aperture 18 of the plate 14. A first row of apertures 30 similarly have the same size opening as the first row of apertures 31 of the plate 14. A second row of apertures 34 are oblong shaped and positionable beneath the circular apertures 36 of the plate 14 but, as the following sets forth, provides an overlapping alignment between the plate and rotatable disk. With continued reference to FIG. 5, each oblong shaped aperture 34 is characterized by a major axis $A_M$. Each major axis $A_M$ is substantially perpendicular to a corresponding line $D_2$ drawn from the axis of rotation $A_R$ to the midpoint of the aperture 34 major axis $A_M$. Each oblong aperture 34 is oriented in a similar relative manner, and line $D_2$ represents a typical line drawn perpendicular to the major axis $A_M$ of a selected oblong aperture 34, extending from the midpoint of the selected aperture major axis to the axis of rotation $A_R$. FIG. 5 also shows that the circular apertures 30 disposed within the rotatable disk 26 lie a uniform distance $D_1$ from the axis of rotation $A_R$.

Figure 6:
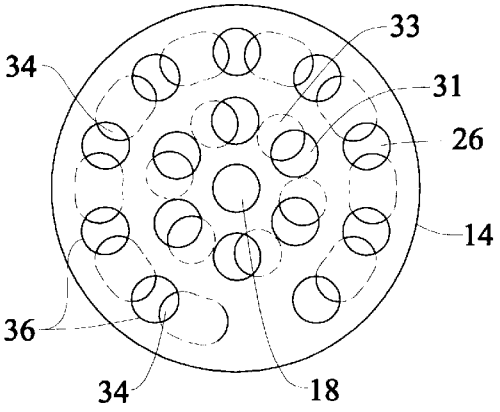
FIG. 6 is a top view of the fixed disk with the rotatable disk placed beneath it and rotated so as to illustrate a locked position.

FIG. 6 illustrates the plate 14 with the rotatable disk 26 placed beneath and rotated into a partially closed position which operates as the locking position. As noted, all apertures, excluding the central aperture 18, remain partially closed wherein retrieval of a golf club placed through the apertures is prohibited. As shown by the first set of apertures 31 the underlying apertures depicted by the hidden lines 33 to close the aperture 31 by partial rotation of the rotatable disk and in relation to the plate. Similarly the second set of apertures 36 are partially closed by slotted apertures 34. The slotted apertures are critical to the design in allowing a rotation of the disk 26 along the outer diameter so as to cause the partial closing of the fixed disk apertures 36 at the same rate closure as the second set of apertures 31.

Figure 7:
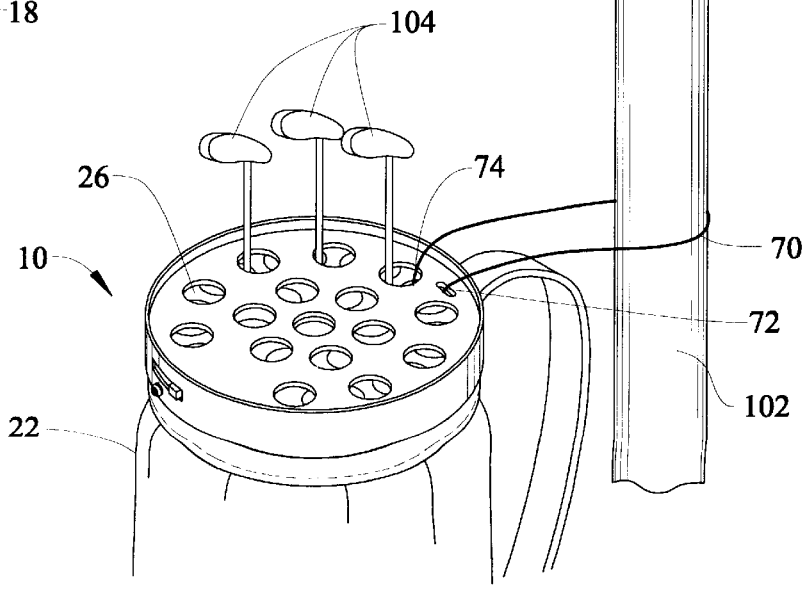
FIG. 7 is a pictorial view of a golf bag having a locking device engaged to prevent clubs from being removed from he bag as well as the bag being removed from a fixed object.

Now referring to FIG. 7, shown is a golf club bag 22 which is propped up to a fence post 102. The bag is filled with golf clubs 104 placed within the apertures of the locking device 10. The rotatable disk 26 has been placed in a locked position wherein golf club removal is not possible. In addition, cable 70 is shown having one end 72 attached to the golf bag and a second end 74 having a ball for insertion into an aperture wherein locking of the clubs in position as shown will prohibit theft of the bag and clubs due to the locking cable 70. The proximal end 72 of the locking cable may simply consist of an eye hoop for securement to a club. In addition, the proximal end and distal ends of the cable may each exist of an eye splice wherein both ends are placed around a shaft of a golf club and once the golf club is locked in position the cable locks the bag and clubs to a fixed object. This allows the clubs and bags to be secured to the golf cart, a fence, even to an automobile. For instance, the device prevents clubs and the golf bag from being taken from a trunk if the cable is secured to any item within the trunk, i.e. tire, fender brace, and so forth. As mentioned above, the annular member 12 may also be formed integral with the top 15 of the golf bag 22. This arrangement is shown in FIG. 7*a*. In this embodiment, the top 15 of the golf bag 22 is adapted to secure the fixed plate 14 and the rotatable disk 26. For example, the bag 22 may be a rigid material, with the bag top 15 being grooved to accept the rotating disk 26 and fixed plate 14. In this embodiment, the bag 15 may be plastic or other similarly-rigid material.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A golf club locking device comprising:

a one piece annular member defined by a vertical sidewall having thickness with a top edge and a bottom edge, said vertical sidewall including a peripheral groove disposed along an inner side surface thereof;

a fixed plate member permanently secured to said inner side surface of said sidewall between said top edge and said groove, said plate member having a first upper set of circular apertures and a second upper set of circular apertures positioned around said first upper set of circular apertures, said first upper set of circular apertures and said second upper set of circular apertures being sized to accommodate the handle of a golf club;

a rotatable disk member having an outer perimeter edge engaging said groove, said rotatable disk member having a first lower set of circular apertures and a second lower set of oblong shaped apertures positioned around said first lower set of circular apertures, said first lower set of circular apertures and said second lower set of oblong shaped apertures being sized to accommodate the handles of golf clubs when said first upper set of circular apertures is placed in vertical alignment with said first lower set of circular apertures and said second upper set of circular apertures is placed in vertical alignment with said second lower set of oblong shaped apertures, each aperture of said first lower set of circular apertures having a center that lies a first distance from an axis of rotation of said rotatable disk member, each aperture of said second lower set of oblong shaped apertures having a major axis that is substantially-orthogonal to a corresponding line extending between said axis of rotation and a midpoint of said major axis, each aperture of said second lower set of oblong shaped apertures having a center that is a second distance from said axis of rotation, said second distance being larger than said first distance;

an actuator for rotating said rotatable disk member;

a spring for biasing said rotatable disk member; and locking mechanism for securing said rotatable disk member in a fixed position;

whereby the handle of each golf club is inserted through said first and second upper set of apertures and said first and second set of lower apertures when said apertures are aligned to form a uniform opening wherein the rotation of said rotatable disk member causes a reduction in the size of the uniform opening to prohibit golf club removal.

2. The golf club locking device according to claim 1 wherein said fixed plate member and said rotatable disk member each have a centrally disposed open aperture.

3. The golf club locking device according to claim 1 wherein said actuator for rotating said rotatable disk member extends through said sidewall of said annular member.

4. The golf club locking device according to claim 1 wherein a portion of said annular member is secured to the top opening of a golf club bag.

5. The golf club locking device according to claim 1 wherein a portion of said annular member is formed integral with the top opening of a golf club bag.

6. The golf club locking device according to claim 1 wherein a first end of said spring is secured to said rotatable disk member and a second end of said spring is secured to said annular member.

7. The golf club locking device according to claim 1 wherein said locking mechanism includes a spring loaded pinion secured to said rotatable disk member, said pinion slidable over a contoured lock tab for keyless locking.

8. The golf club locking device according to claim 1 including a flexible steel cable having a proximal end secured to a golf bag and a distal end sized for insertion into one of said apertures.

9. The golf club locking device according to claim 1 wherein said spring bias upper apertures of said fixed plate member to be in vertical alignment with said lower apertures of said rotatable disk member.

10. The golf club locking device according to claim 1 wherein said annular member is formed integral with a golf club bag.

11. The golf club locking device according to claim 1 wherein said locking mechanism includes a keyless locking mechanism.

12. A golf club locking device comprising:

a one piece annular member securable to the top opening of a golf club bag; said annular member defined by a vertical sidewall having thickness with a top edge and a bottom edge, said vertical sidewall including a peripheral groove disposed along an inner side surface thereof;

a fixed plate member permanently secured to said inner side surface of said sidewall between said top edge and said groove, said plate member having a centrally disposed open aperture with a first upper set of circular apertures positioned around said open aperture and a second upper set of circular apertures positioned around said first upper set of circular apertures, said first upper set of circular apertures and said second upper set of circular apertures being sized to accommodate the handles of golf clubs;

a rotatable disk member having an outer perimeter edge disposed said groove, said rotatable disk member having a centrally disposed open aperture with a first lower set of circular apertures positioned around said open aperture and a second lower set of oblong shaped apertures positioned around said first lower set of circular apertures, said first lower set of circular apertures and said second lower set of oblong shaped apertures being sized to accommodate the handles of golf clubs when said first upper set of circular apertures is placed in vertical alignment with said first lower set of circular apertures and said second upper set of circular apertures is place in vertical alignment with said second lower set of oblong shaped apertures, each aperture of said first lower set of circular apertures having a center that lies a first distance from an axis of rotation of said rotatable disk member, each aperture of said second lower set of oblong shaped apertures having a major axis that is substantially-orthogonal to a corresponding line extending between said axis of rotation and a midpoint of said major axis, each aperture of said second lower set of oblong shaped apertures having a center that is a second distance from said axis of rotation, said second distance being larger than said first distance;

an actuator for rotating said rotatable disk member, said actuator accessible through said sidewall of said annular member;

a spring for biasing said rotatable disk member to allow said upper apertures of said fixed plate member to be in vertical alignment with said lower apertures of said rotatable disk member; and locking mechanism for securing said rotatable disk member in a fixed position;

whereby the handles of golf clubs are inserted through said first and second upper set of apertures and said first and second set of lower apertures when said apertures are aligned to form a uniform opening wherein the rotation of said rotatable disk member causes a reduction in the size of the uniform opening to prohibit golf club removal.

13. The golf club locking device according to claim 12 including a flexible steel cable having a proximal end secured to a golf bag and a distal end sized for insertion into one of said apertures.

* * * * *